US008952883B2

(12) United States Patent
Lee et al.

(10) Patent No.: US 8,952,883 B2
(45) Date of Patent: Feb. 10, 2015

(54) METHOD OF DRIVING ELECTROPHORETIC DISPLAY WITH GRAY PIXELS

(75) Inventors: Il-Pyung Lee, Suwon-si (KR); Sung-Jin Hong, Seoul (KR); Cheol-Woo Park, Suwon-si (KR); Yong-Woo Lee, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 1320 days.

(21) Appl. No.: 12/266,778

(22) Filed: Nov. 7, 2008

(65) Prior Publication Data

US 2009/0244105 A1 Oct. 1, 2009

(30) Foreign Application Priority Data

Mar. 31, 2008 (KR) ..... 10-2008-0029763

(51) Int. Cl.
*G09G 3/34* (2006.01)
*G09G 3/20* (2006.01)

(52) U.S. Cl.
CPC ..... *G09G 3/344* (2013.01); *G09G 3/2007* (2013.01); *G09G 2310/06* (2013.01); *G09G 2320/02* (2013.01); *G09G 2340/0407* (2013.01)
USPC ..... 345/107

(58) Field of Classification Search
CPC ..... G09G 3/344
USPC ..... 345/107
See application file for complete search history.

(56) References Cited

U.S. PATENT DOCUMENTS

| | | | | |
|---|---|---|---|---|
| 5,254,981 | A * | 10/1993 | Disanto et al. | 345/107 |
| 6,239,896 | B1 * | 5/2001 | Ikeda | 359/240 |
| 6,384,839 | B1 * | 5/2002 | Paul | 345/613 |
| 6,531,997 | B1 * | 3/2003 | Gates et al. | 345/107 |
| 6,639,580 | B1 * | 10/2003 | Kishi et al. | 345/107 |
| 2003/0011869 | A1 * | 1/2003 | Matsuda et al. | 359/296 |
| 2003/0117016 | A1 * | 6/2003 | Ukigaya | 305/107 |
| 2004/0184136 | A1 * | 9/2004 | Goden | 359/296 |
| 2005/0012979 | A1 * | 1/2005 | Minami | 359/296 |
| 2005/0280626 | A1 * | 12/2005 | Amundson et al. | 345/107 |
| 2006/0139305 | A1 | 6/2006 | Zhou | |
| 2006/0146008 | A1 | 7/2006 | Johnson | |
| 2006/0187189 | A1 * | 8/2006 | Komatsu | 345/107 |
| 2006/0221049 | A1 * | 10/2006 | Miyasaka et al. | 345/107 |
| 2006/0232547 | A1 | 10/2006 | Johnson | |
| 2006/0262080 | A1 * | 11/2006 | Matsuda | 345/107 |
| 2007/0212022 | A1 | 9/2007 | Zhou | |
| 2008/0048968 | A1 * | 2/2008 | Okada et al. | 345/107 |
| 2008/0136773 | A1 * | 6/2008 | Kim et al. | 345/107 |

(Continued)

FOREIGN PATENT DOCUMENTS

| | | |
|---|---|---|
| JP | 2005345879 | 12/2005 |
| JP | 2005352315 | 12/2005 |

(Continued)

*Primary Examiner* — Claire X Pappas
*Assistant Examiner* — Robert Stone
(74) *Attorney, Agent, or Firm* — H.C. Park & Associates, PLC

(57) ABSTRACT

The present invention relates to a driving method of an electrophoretic display. The driving method of the electrophoretic display includes displaying a first gray at a first pixel and a second pixel, where a target gray of the first pixel is the first gray and a target gray of the second pixel is a second gray, and changing the second pixel from the first gray to the second gray.

10 Claims, 7 Drawing Sheets

(56) References Cited

U.S. PATENT DOCUMENTS

| | | | | |
|---|---|---|---|---|
| 2008/0204399 | A1* | 8/2008 | Choi et al. | 345/107 |
| 2008/0238867 | A1* | 10/2008 | Maeda et al. | 345/107 |
| 2008/0273022 | A1* | 11/2008 | Komatsu | 345/205 |
| 2009/0009465 | A1* | 1/2009 | Choi et al. | 345/107 |
| 2009/0046114 | A1* | 2/2009 | Lee et al. | 345/691 |
| 2009/0058797 | A1* | 3/2009 | Hirayama | 345/107 |
| 2009/0096773 | A1* | 4/2009 | Moriya et al. | 345/205 |
| 2009/0223821 | A1* | 9/2009 | Abe | 204/450 |
| 2009/0237351 | A1* | 9/2009 | Kanamori et al. | 345/107 |

FOREIGN PATENT DOCUMENTS

| | | |
|---|---|---|
| JP | 2007079146 | 3/2007 |
| JP | 2007108355 | 4/2007 |
| JP | 2007225757 | 9/2007 |
| KR | 1020050092780 | 9/2005 |
| KR | 1020070019438 | 2/2007 |
| KR | 1020070031862 | 3/2007 |
| KR | 1020070048704 | 5/2007 |

* cited by examiner

METHOD OF DRIVING ELECTROPHORETIC DISPLAY WITH GRAY PIXELS

CROSS-REFERENCE TO RELATED APPLICATION

This application claims priority from and the benefit of Korean Patent Application No. 10-2008-0029763, filed on Mar. 31, 2008, which is hereby incorporated by reference for all purposes as if fully set forth herein.

BACKGROUND OF THE INVENTION

1. Field of the Invention

The present invention relates to a display device. More particularly, the present invention relates to a driving method of an electrophoretic display.

2. Discussion of the Background

Much research has been undertaken to develop an electrophoretic display (EPD) as a flat panel display device, as well as a liquid crystal display and an organic light emitting device.

An electrophoretic display includes a plurality of pixels that each have an electrophoretic capacitor and a switching element. The electrophoretic capacitor includes two electrodes facing each other and an electrophoretic layer between the two electrodes, and the electrophoretic layer includes a plurality of electrified particles having different colors and different polarities.

When a potential difference is induced between the two electrodes, the electrified particles move in a uniform direction according to the polarity thereof. Since electrified particles having different polarities have different colors, a desired image may be displayed by applying different voltages to the two electrodes.

The resolution of the electrophoretic display is determined according to the size of a pixel. Therefore, it may be difficult to display an image with greater precision than the size of the pixel, and it also may be difficult to control characteristics of an image differently in different areas of the screen.

SUMMARY OF THE INVENTION

The present invention discloses a method of driving an electrophoretic display.

Additional features of the invention will be set forth in the description which follows, and in part will be apparent from the description, or may be learned by practice of the invention.

An exemplary embodiment of the present invention discloses a method of driving an electrophoretic display including a plurality of pixels that each have a switching element and an electrophoretic capacitor. The method includes displaying a first gray at a first pixel and a second pixel, where a target gray of the first pixel is the first gray and a target gray of the second pixel is a second gray. Then, the second pixel is changed from the first gray to the second gray.

Another exemplary embodiment of the present invention also discloses a method of driving an electrophoretic display to display a first color at a first area of a display panel and to display a second color at a second area of the display panel. The display panel includes a plurality of pixels that each have a switching element and an electrophoretic capacitor. In the driving method, the first color is displayed at the first and second areas, and a color displayed at the second area is changed from the first color to the second color.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
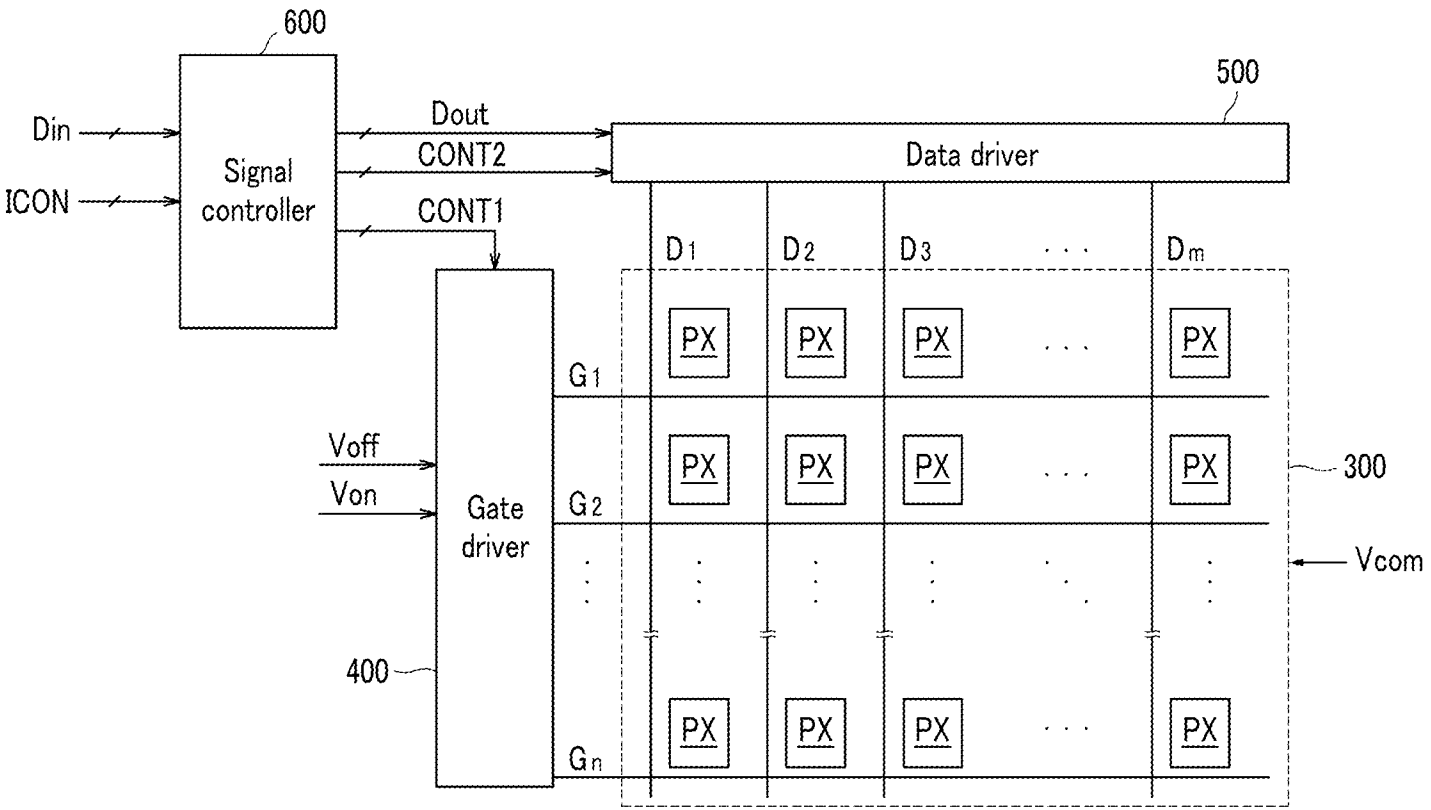
FIG. 1 is a block diagram of an electrophoretic display according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Hereinafter, an electrophoretic display according to an exemplary embodiment of the present invention will be described with reference to FIG. 1, FIG. 2, and FIG. 3.

FIG. 1 is a block diagram of an electrophoretic display according to an exemplary embodiment of the present invention. FIG. 2 is an equivalent circuit diagram of a pixel in an electrophoretic display according to an exemplary embodiment of the present invention, and FIG. 3 is a schematic cross-sectional view of an electrophoretic display according to an exemplary embodiment of the present invention.

Referring to FIG. 1, the display device according to an exemplary embodiment of the present invention includes a panel unit 300, a gate driver 400, a data driver 500, and a signal controller 600.

Figure 2:
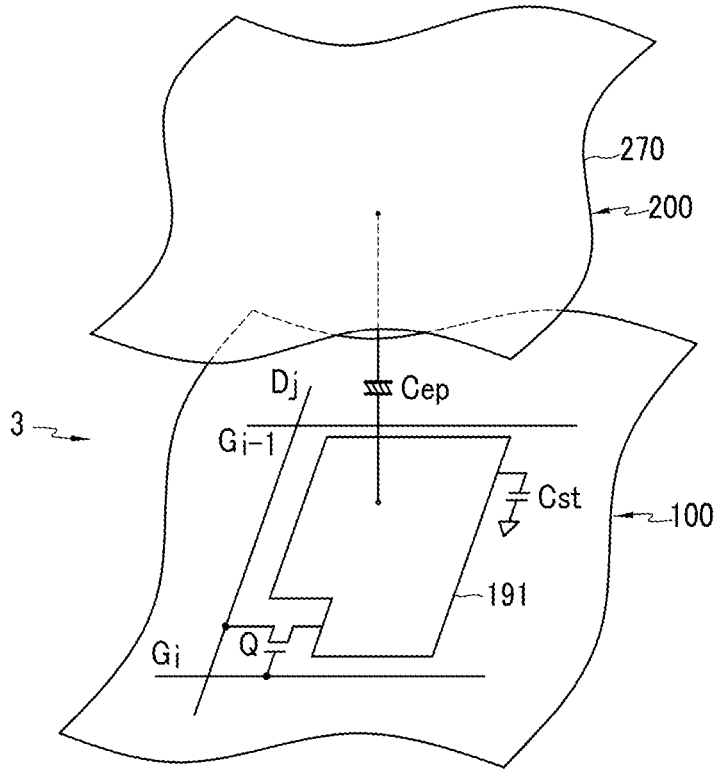
FIG. 2 is an equivalent circuit diagram of a pixel in an electrophoretic display according to an exemplary embodiment of the present invention.

As shown in FIG. 1 and FIG. 2, the panel unit 300 includes a plurality of pixels PX connected to a plurality of signal lines $G_1$-$G_n$ and $D_1$-$D_m$ and arranged in the form of matrix. The panel unit 300 includes a lower panel 100, an upper panel 200 facing the lower panel 100, and an electrophoretic layer 3 disposed between the lower panel 100 and the upper panel 200, as shown in FIG. 2 and FIG. 3.

The plurality of signal lines $G_1$-$G_n$ and $D_1$-$D_m$ are disposed at the lower panel 100. The plurality of signal lines $G_1$-$G_n$ and $D_1$-$D_m$ include a plurality of gate lines $G_1$-$G_n$ to transfer a gate signal and a plurality of data lines $D_1$-$D_m$ to transfer a data voltage. The gate signal may be referred to as a scanning signal. The plurality of gate lines $G_1$-$G_n$ extend basically in a row direction and run parallel to each other. The plurality of data lines $D_1$-$D_m$ extend basically in a column direction and run parallel to each other.

Referring to FIG. 2, each pixel PX, such as a pixel PX connected to an $i^{th}$ row (i=1, 2, . . . , n) and a $j^{th}$ column (j=1, 2, . . . , m), includes a switching element Q connected to signal lines $G_i$ and $D_j$, an electrophoretic capacitor Cep connected to the switching element Q, and a storage capacitor Cst.

The switching element Q is a three terminal element, such as a thin film transistor, included in the lower panel 100. The thin film transistor includes a control terminal connected to the gate line $G_i$, an input terminal connected to the data line $D_j$, and an output terminal connected to an electrophoretic capacitor Cep and a storage capacitor Cst.

The terminals of the electrophoretic capacitor Cep are a pixel electrode 191 of the lower panel 100 and a common electrode 270 of the upper panel 200, and the electrophoretic layer 3 between the two electrodes 191 and 270 functions as a dielectric material. The pixel electrode 191 is connected to the switching element Q, and the common electrode 270 is formed across an entire surface of the upper panel 200 and receives a common voltage Vcom.

Figure 3:
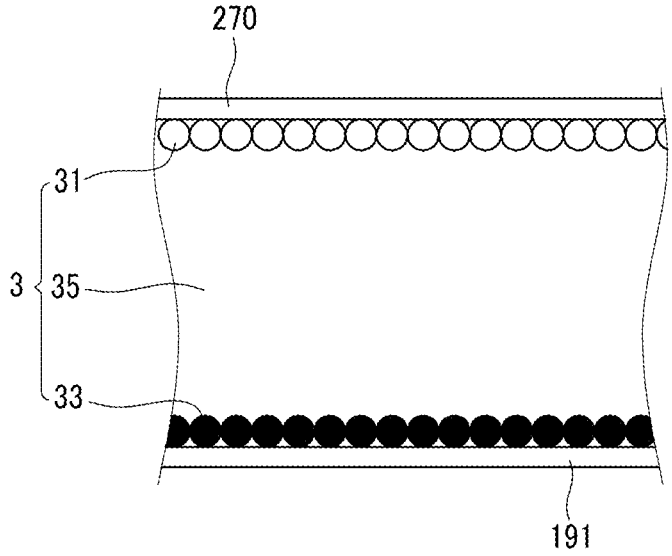
FIG. 3 is a schematic cross-sectional view of an electrophoretic display according to an exemplary embodiment of the present invention.

As shown in FIG. 3, the electrophoretic layer 3 may include white electrified particles 31, black electrified particles 33, and a transparent fluid 35. The white particles 31 and the black particles 33 are electrified with opposite polarities. The electrified particles 31 and 33 and the transparent dielectric fluid 35 may be filled in micro-capsules.

An additional signal line (not shown) and the pixel electrode 191 provided on the lower display panel 100 overlap each other with an insulator interposed therebetween to obtain a storage capacitor Cst that supplements the electrophoretic capacitor Cep. A voltage, such as a common voltage Vcom, is applied to the additional signal line. However, the pixel electrode 191 may overlap a previous gate line $G_{i-1}$ with an insulator between them to form the storage capacitor Cst. The storage capacitor Cst may be omitted as occasion demands.

Referring to FIG. 1 again, the gate driver 400 is connected to the gate lines $G_1$-$G_n$ of the panel unit 300 and applies gate signals to the gate lines $G_1$-$G_n$. Each gate signal is formed of a gate-on voltage Von to turn on the switching element Q and a gate-off voltage Voff to turn off the switching element Q.

The data driver 500 is connected to the data lines $D_1$-$D_m$ of the panel unit 300 and applies data voltages to the data lines $D_1$-$D_m$.

The signal controller 600 controls the gate driver 400 and the data driver 500.

Each driving apparatus 400, 500, and 600 may include at least one integrated circuit (IC) chip (not shown) mounted on the panel unit 300 or on a flexible printed circuit (FPC) film (not shown) in a tape carrier package (TCP), which is attached to the panel unit 300. Alternatively, each driving apparatus 400, 500, and 600 may be mounted on a separate printed circuit board (PCB) (not shown). In another option, at least one of the driving apparatuses 400, 500, and 600 may be integrated into the panel unit 300 along with the signal lines $G_1$-$G_n$ and $D_1$-$D_m$ and the switching elements Q. Also, the driving apparatuses 400, 500, and 600 may be integrated into a single IC chip. In this case, at least one circuit element forming them may be provided outside the single chip.

The operation of the electrophoretic display will now be described in detail.

The signal controller 600 receives input image signals Din and input control signals ICON to control the display operation of the input image signals Din received from an external graphics controller (not shown). The input image signals Din contain luminance information of the pixels PX, and the luminance has a specific number of grays, for example 1024 ($=2^{10}$), 256 ($=2^8$), or 64 ($=2^6$) grays. The input control signals ICON may include a vertical synchronization signal, a horizontal synchronizing signal, a main clock signal, and a data enable signal.

The signal controller 600 generates gate control signals CONT1 and data control signals CONT2 on the basis of the input image signals Din and the input control signals ICON and processes the input image signals Din to generate the output image signals Dout suitable for the operation of the panel unit 300 and the data driver 500. The signal controller 600 sends the gate control signals CONT1 to the gate driver 400 and sends the output image signals Dout and the data control signals CONT2 to the data driver 500.

The gate control signals CONT1 may include a scanning start signal to start scanning and at least one clock signal to control an output period of the gate-on voltage Von. The gate control signals CONT1 may further include an output enable signal to define the duration of the gate-on voltage Von.

The data control signals CONT2 may include a horizontal synchronization start signal to start the transmission of the digital output image signals Dout for a row of pixels PX, and a load signal to apply analog data voltages to the data lines $D_1$-$D_m$, and a data clock signal.

Responsive to the data control signals CONT2 from the signal controller 600, the data driver 500 receives the digital image signals Dout for the row of pixels PX, converts the digital image signals Dout to analog data voltages, and applies the analog data voltages to corresponding data lines $D_1$-$D_m$.

The gate driver 400 applies the gate-on voltage Von to the gate lines $G_1$-$G_n$ in response to the gate control signals CONT1 from the signal controller 600, thereby turning on the switching elements Q connected to the gate lines $G_1$-$G_n$. Then, the data voltages applied to the data lines $D_1$-$D_m$ are supplied to the pixels PX through the turned-on switching elements Q.

When a data voltage Vd is applied to an electrophoretic capacitor Cep, the positions of the electrified particles 31 and 33 are changed according to the magnitude, polarity, and duration of the applied data voltage Vd.

For example, when the white electrified particles 31 are close to the common electrode 270 as shown in FIG. 3, the electrophoretic display may represent a white color. To the contrary, when the black electrified particles 33 are close to the common electrode 270, the electrophoretic display may represent a black color. When the white and black electrified particles 31 and 33 are located at a central region between the common electrode 270 and the pixel electrode 191, the electrophoretic display may represent a gray color. As described above, the electrophoretic display may display luminance of a gray of an image signal Dout by changing positions of the electrified particles 31 and 33.

An image of a frame is displayed by sequentially applying the gate-on voltage Von to all of the gate lines $G_1$-$G_n$ and applying the data voltages to all of the pixels PX by repeating the above-described process in units of 1 horizontal period 1H (one period of the horizontal synchronizing signal and a data enable signal).

However, a monochromatic electrophoretic display according to an exemplary embodiment of the present invention displays a white color or a black color on all or a part of a screen before displaying an image represented by input image signals Din. The process sharpens or rounds a boundary of an object or a line to be displayed, which may increase the resolution.

This will be described in more detail with reference to FIG. 4, FIG. 5, FIG. 6, and FIG. 7.

FIG. 4, FIG. 5, FIG. 6, and FIG. 7 are schematic cross-sectional views showing the operation of an electrophoretic display according to an exemplary embodiment of the present invention.

FIG. 4, FIG. 5, FIG. 6, and FIG. 7 show two adjacent pixel electrodes 191L and 190R, a common electrode 270, white electrified particles 31, and black electrified particles 33. For descriptive convenience, it is assumed that 0 V is applied to the common electrode 270 as the common voltage Vcom, the white particles 31 are electrified with a positive polarity (+), and the black color particles 33 are electrified with a negative polarity (−).

Figure 4:
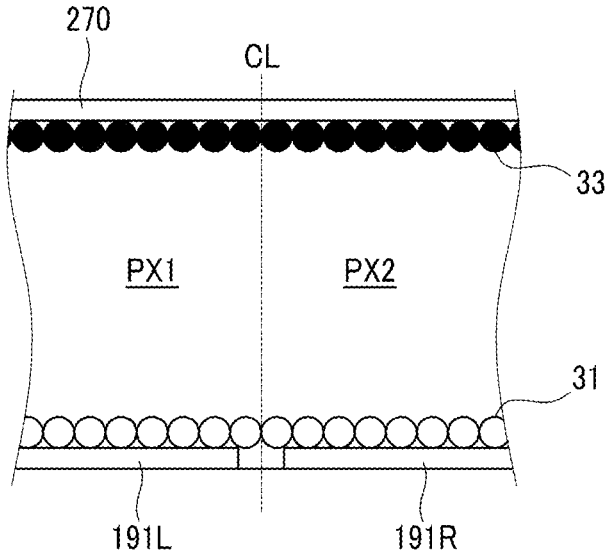
FIG. 4, FIG. 5, FIG. 6, and FIG. 7 are cross-sectional views describing operations of an electrophoretic display according to an exemplary embodiment of the present invention.

Referring to FIG. 4, since the black particles 33 are close to the common electrode 270 and the white particles 31 are located near the pixel electrodes 191L and 191R, a pixel PX1 including the pixel electrode 191L and a pixel PX2 including the pixel electrode 191R represent a black color. A boundary or a center line CL is substantially equidistant from the two pixel electrodes 191L and 191R.

In this condition, a positive (+) voltage is applied to the left pixel electrode 191L and a 0 V voltage is applied to the right pixel electrode 191R to control the left pixel PX1 to display a white color while the right pixel PX2 continues to display the black. As a result, there is no voltage difference between the right pixel electrode 191R and the common electrode 270, and the voltage of the left pixel electrode 191L becomes different from the voltage of the common electrode 270 and the right pixel electrode 191R. Therefore, electric fields in a direction toward the common electrode 270 are generated not only in the left pixel PX1 but also near a left boundary of the right pixel PX2.

Figure 5:
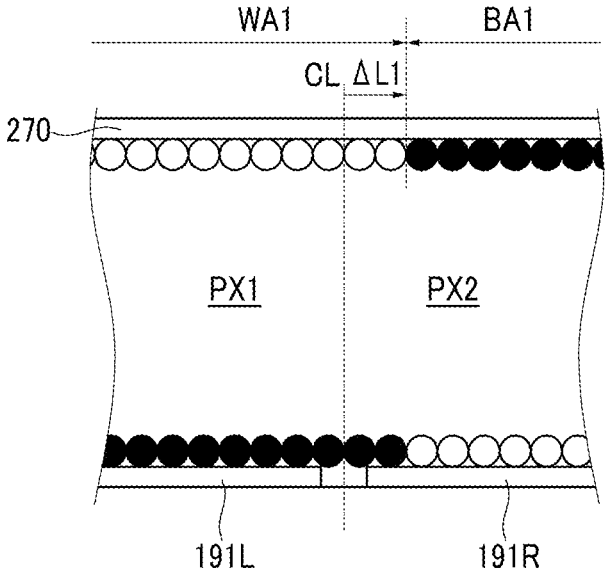

As shown in FIG. 5, not only electrified particles 31 and 33 disposed in the left pixel PX1, but also those located at the right side of the center line, move. Since the white particles 31 have the positive polarity, the white particles 31 move upward. Since the black particles 33 have the negative polarity, the black particles 33 move downward. Therefore, the white particles 31 and the black particles 33 switch positions. A region from the left pixel electrode 191L to a position that is away from the center line CL by a distance ΔL1 forms a white display area WA1 due to the exchange of positions of the electrified particles 31 and 33. The remaining region becomes a black display area BA1. That is, the white display area WA1 becomes wider than the black display area BA1.

Figure 6:
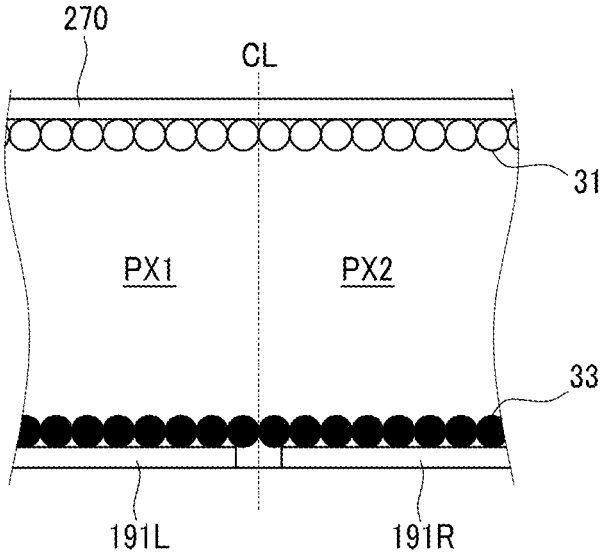

Referring to FIG. 6, the white particles 31 are close to the common electrode 270 and the black color particles 33 are located near the pixel electrodes 191L and 191R unlike in FIG. 4. Therefore, the two pixels PX1 and PX2 display a white color.

To control the left pixel PX1 to display a white color and the right pixel PX2 to display a black color, as in FIG. 5, a 0 V voltage is applied to the left pixel electrode 191L and an negative (−) voltage is applied to the right pixel electrode 191R. Then, no voltage difference is induced between the left pixel electrode 191L and the common electrode 270, and the right pixel electrode 191R has a voltage difference from the common electrode 270 and the left pixel electrode 191L. Therefore, an electric field is induced not only in the right pixel PX2 but also around a right boundary of the left pixel PX1 in a downward direction from the common electrode 270.

Figure 7:
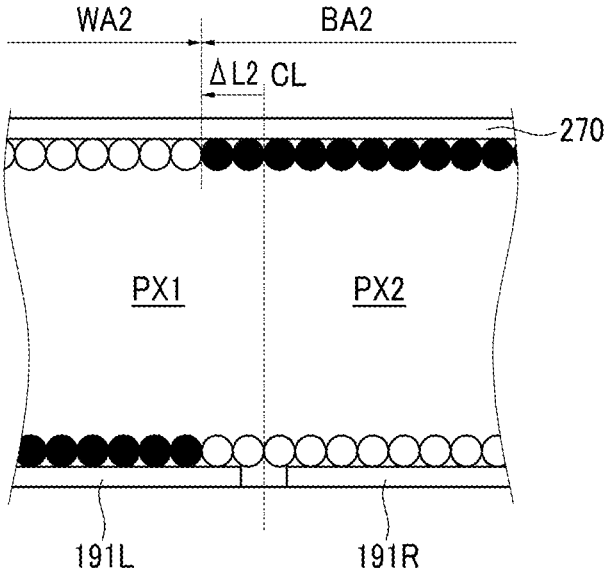

Therefore, as shown in FIG. 7, not only electrified particles 31 and 33 in the right pixel PX2, but also electrified particles 31 and 33 located at the left side of the center line CL, move. Since the electric field faces the downward direction, the positive white particles 31 move downward, and the negative black particles 33 move upward. A white display area WA2 is reduced in an inside direction to a point that is away from the center line CL by a distance ΔL2. Therefore, the black display area BA2 becomes wide.

In other words, the areas of the white display areas WA1 and WA2 and the black display areas BA1 and BA2 are changed according to a previous condition even though the left pixel PX1 displays a white color and the right pixel PX2 displays a black color. For example, if it is required to display a black line with a sharp boundary when the black line is displayed with a white background as shown in FIG. 4 and FIG. 5, the entire screen is displayed in a black color and then the background part is changed to a white color. To the contrary, if a line is to be displayed with a smooth boundary, the entire screen is displayed in a white color and then a line part is changed to a black color as shown in FIG. 6 and FIG. 7. Displaying a white line with a black background can be considered as a display operation that is opposite to that described above.

It may be possible to substantially improve the electrophoretic display through the above-described operations.

Meanwhile, if an electric field of a uniform direction is continuously applied to the electrified particles 31 and 33, the characteristics of the electrified particles 31 and 33 may deteriorate. Therefore, an electric field may be applied in an opposite direction. For example, if it is required to apply a positive (+) voltage to the pixel electrode 191 to display a predetermined image, a negative (−) voltage may be applied to the pixel electrode 191 before applying the positive voltage to the pixel electrode 191.

Since a negative voltage is applied as an initial voltage to the pixel electrode 191L to create the condition of FIG. 4 in the case of the left pixel PX1 of FIG. 4 and FIG. 5, a positive voltage is applied to the pixel electrode 191L before the negative voltage is applied to the pixel electrode 191L. Since the positive voltage is applied to create the condition of FIG. 5, the negative voltage is applied before applying the positive voltage. Finally, the positive voltage, the negative voltage, the negative voltage, and the positive voltage are sequentially applied to the left pixel PX1.

In case of the right pixel PX2 of FIG. 4 and FIG. 5, the positive voltage and the negative voltage are sequentially applied to the right pixel PX2 to create the condition of FIG. 4, like the left pixel PX1. Then, since a 0 V voltage is applied to the pixel electrode 191R to create the condition of FIG. 5, a 0 V voltage is applied before applying the 0 V voltage. That is, a positive voltage, a negative voltage, a 0 V voltage, and a 0 V voltage are sequentially applied to the right pixel PX2.

The operation of applying a voltage will be described for two pixels PX1 and PX2 shown in FIG. 6 and FIG. 7 hereinafter. Since the positive voltage is applied to the pixel electrode 191L as an initial voltage to create the condition of FIG. 6 in the case of the left pixel PX1, an opposite voltage thereof is a negative voltage. Then, since a 0 V voltage is applied to the left pixel electrode 191L to create the condition of FIG. 7, the opposite voltage thereof is also a 0 V voltage. Finally, a negative voltage, a positive voltage, a 0 V voltage, and a 0 V voltage are sequentially applied to the left pixel PX1.

If the right pixel PX2 is to have the condition of FIG. 6, a negative voltage and a positive voltage are sequentially applied to the pixel electrode 191R, like with the left pixel PX1. Then, since the negative voltage is applied to the right pixel electrode 191R to control the right pixel PX2 to have the condition the pixel electrode 191R of FIG. 7, the opposite voltage thereof is the positive voltage. Resultantly, a negative voltage, a positive voltage, a positive voltage, and a negative voltage are sequentially applied to the right pixel PX2.

Hereinafter, a method of displaying an image in an electrophoretic display according to an exemplary embodiment of the present invention will be described with reference to FIG. 8, FIG. 9, FIG. 10, and FIG. 11.

Figure 8:
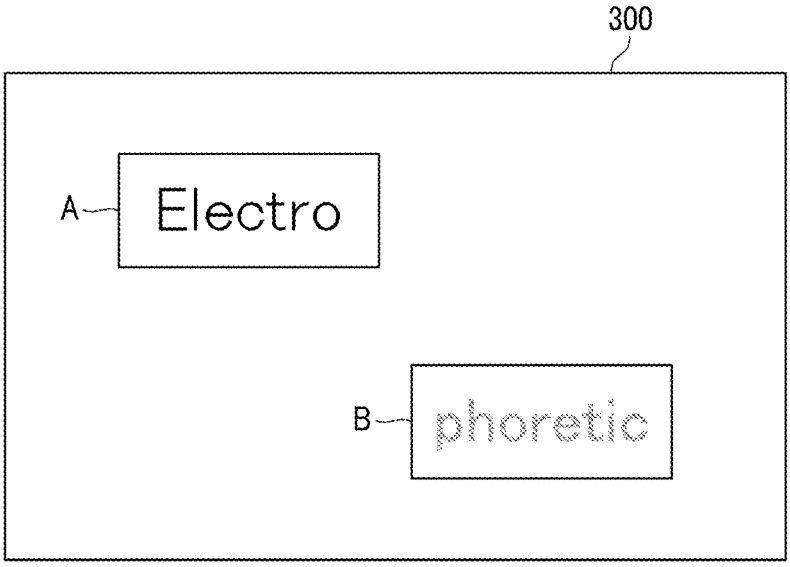
FIG. 8 shows a display panel of an electrophoretic display according to an exemplary embodiment of the present invention.
Figure 9:
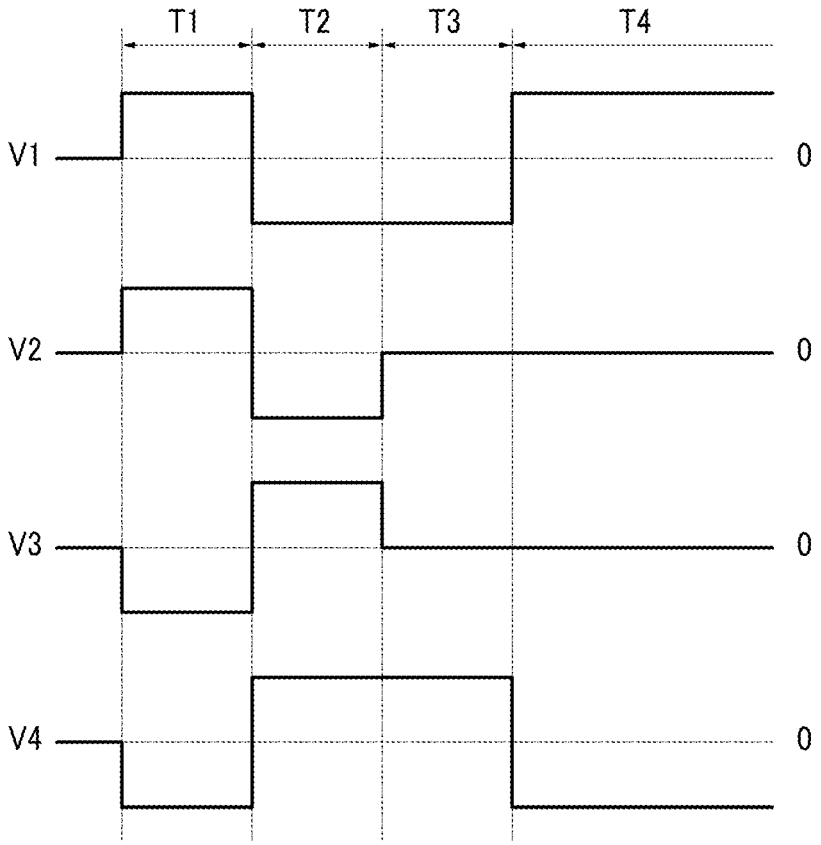
FIG. 9 is a waveform of a voltage applied to a pixel to display an image shown in FIG. 8.
Figure 10:
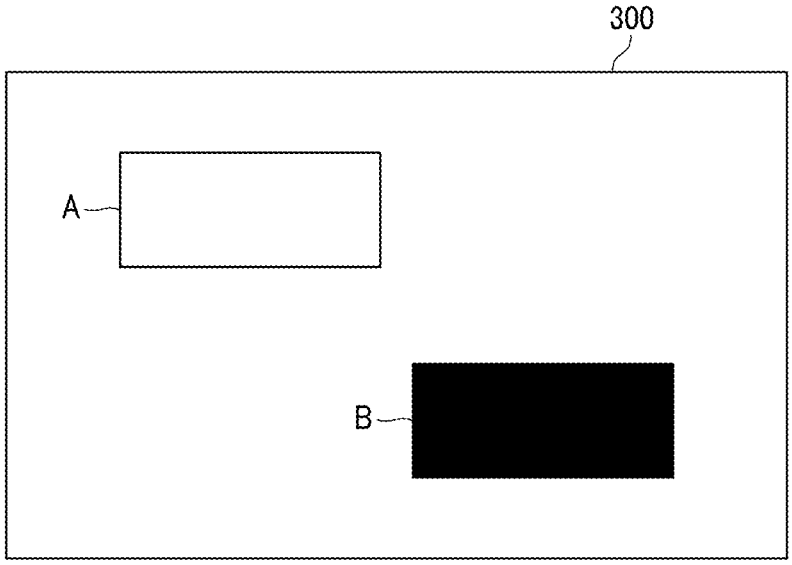
FIG. 10 and FIG. 11 show images displayed in a period shown in FIG. 9.
Figure 11:
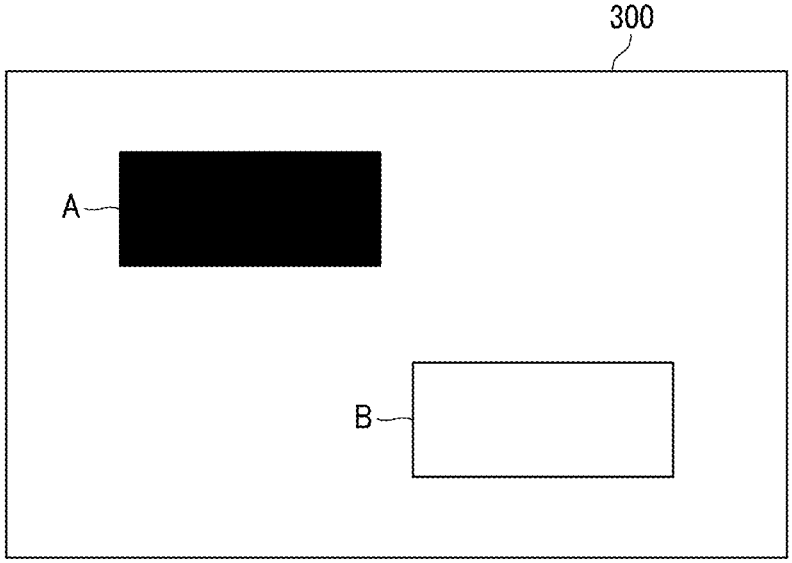

FIG. 8 shows a display panel of an electrophoretic display according to an exemplary embodiment of the present invention, FIG. 9 is a waveform of a voltage applied to a pixel to display an image shown in FIG. 8, and FIG. 10 and FIG. 11 show images displayed in a period shown in FIG. 9.

As shown in FIG. 8, it is assumed that a panel unit 300 displays an image having black letters on a white background. It is also assumed that the letters are sharply displayed at a first area A and the letters are dully displayed at a second area B.

Then, pixels of the first area A are driven according to a method described in FIG. 4 and FIG. 5, and pixels of the second area B are driven according to a method described in FIG. 6 and FIG. 7. In the first area A, pixels for a background are referred to as PL1 and pixels for letters are referred to as PL2. In the second area B, pixels for a background are referred to as PL3 and pixels for letters are referred to as PL4.

Then, the pixel PL1 corresponds to the left pixel PX1 in FIG. 4 and FIG. 5, and the pixel PL2 corresponds to the right pixel PX2 in FIG. 4 and FIG. 5. Also, the pixel PL3 corresponds to the left pixel PX1 of FIG. 6 and FIG. 7, and the pixel PL4 corresponds to the right pixel PX2 of FIG. 6 and FIG. 7.

Therefore, voltages V1, V2, V3, and V4 are applied to each pixel PL1, PL2, PL3, and PL4, as shown in FIG. 9. That is, a positive voltage, a negative voltage, a negative voltage, and a positive voltage are sequentially applied to the pixel PL1. A positive voltage, a negative voltage, a 0 V voltage, and a 0 V voltage are sequentially applied to the pixel PL2. A negative voltage, a positive voltage, a 0 V voltage, and a 0 V voltage are sequentially applied to the pixel PL3. A negative voltage, a positive voltage, a positive voltage, and a negative voltage are sequentially applied to the pixel PL4.

If divided by periods T1, T2, T3, and T4, the pixels PL1 and PL2 of the first area A display a white color and the pixels PL3 and PL4 of the second area B display a black color in an initial opposite voltage applying period T1 as shown in FIG. 10. In an initial voltage applying period T2, the pixels PL1 and PL2 of the first area A display a black color and the pixels PL3 and PL4 of the second area B display a white color, contrary to the period T1 (see FIG. 11). In an opposite voltage applying period T3, a voltage having the same polarity is applied or a 0 V voltage is applied. Therefore, the displayed colors are not changed. That is, the colors of FIG. 11 are sustained.

In a voltage applying period T4 where a voltage is applied to display an image, the pixel PL2 for letters is sustained as it is and the pixel PL1 for a background is changed to a white color in the area A. To the contrary, the pixel PL3 for the background is sustained as it is and the pixel PL4 for a letter is changed to a black color in the second area B. Finally, an image is displayed as shown in FIG. 8.

The time for the electrified particles 31 and 33 of the electrophoretic display to move from one electrode to the other electrode is about 200 to 300 ms. Since this may be longer than the time of one frame, which may be about 16.7 ms, a length of each period T1, T2, T3, and T4 is also set up based thereon.

As described above, an image having various boundary characteristics may be displayed on one screen.

Such a method may be applied to an electrophoretic display to display a gray color.

For example, if a target gray of a first pixel is a first gray and a target gray of a second pixel is a second gray when an electrophoretic display displays an image, both of the first pixel and the second pixel display the first gray or the second gray at first and then a pixel not displaying the target gray is changed to the target gray. Since it is not necessary to change the pixel displaying the target gray, a 0 V voltage is applied to the pixel displaying the target gray, and a non-zero voltage is applied to a pixel not displaying a target gray thereof. Therefore, the sharpness of an image may be changed because electric field expansion occurs as described with reference to FIG. 4 and FIG. 5.

As described above, an image can be displayed with greater precision than a size of the pixel in the electrophoretic display. Also, the sharpness of portions of the image may be differently controlled using different driving methods according to a position thereof.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving an electrophoretic display comprising pixels that each have a switching element and an electrophoretic capacitor, the method comprising:

receiving luminance information of a first image, the luminance information comprising target grays of the first image for each pixel;

displaying a first gray both at a first pixel and an adjacent second pixel, and displaying a second gray both at a third pixel and an adjacent fourth pixel, where the target gray of the first pixel is the first gray, the target gray of the second pixel is the second gray, the target gray of the third pixel is the first gray, and the target gray of the fourth pixel is the second gray; and changing the second pixel from the first gray to the second gray, by applying a first voltage to the second pixel and a zero voltage to the first pixel, such that a portion of the first pixel displays the second gray while the remainder of the first pixel displays the first gray, and changing the third pixel from the second gray to the first gray, by applying a second voltage to the third pixel and a zero voltage to the fourth pixel, such that a portion of the fourth pixel displays the first gray while a remainder of the fourth pixel displays the second gray, to display the target grays of the first image, wherein the first voltage and the second voltage have different polarities.

2. The driving method of claim 1, further comprising applying a voltage that is opposite to the first voltage to the second pixel before applying the first voltage.

3. The driving method of claim 1, wherein the displaying the first gray both at the first pixel and the second pixel comprises applying a second voltage to the first pixel and the second pixel.

4. The driving method of claim 3, further comprising applying a voltage that is opposite to the second voltage to the first pixel and the second pixel before the applying the second voltage.

5. The driving method of claim 1, wherein the first gray represents a black color and the second gray represents a white color.

6. The driving method of claim 1, wherein the first gray represents a white color and the second gray represents a black color.

7. The driving method of claim 1, further comprising:

applying a voltage that is opposite to the first voltage to the second pixel before applying the first voltage; and applying a voltage that is opposite to the second voltage to the third pixel before applying the second voltage.

8. The driving method of claim 7, wherein the displaying the first gray both at the first pixel and the second pixel comprises applying a third voltage to the first pixel and the second pixel, and wherein displaying the second gray at the third pixel and the fourth pixel comprises applying a fourth voltage to the third pixel and the fourth pixel.

9. The driving method of claim 8, further comprising:

applying a voltage that is opposite to the third voltage to the first pixel and the second pixel before applying the third voltage; and applying a voltage that is opposite to the fourth voltage to the third pixel and the fourth pixel before applying the fourth voltage.

10. The driving method of claim 1, wherein:

the first and second pixels share a boundary;

the third and fourth pixels share a boundary; and the displaying and changing increases the resolution of the first image.

* * * * *